United States Patent [19]

Grappendorf

[11] Patent Number: 4,744,427

[45] Date of Patent: May 17, 1988

[54] BIT DESIGN FOR A ROTATING BIT INCORPORATING SYNTHETIC POLYCRYSTALLINE CUTTERS

[75] Inventor: Richard H. Grappendorf, Riverton, Utah

[73] Assignee: Eastman Christensen Company, Salt Lake City, Utah

[21] Appl. No.: 919,712

[22] Filed: Oct. 16, 1986

[51] Int. Cl.[4] ..... E21B 10/50

[52] U.S. Cl. ..... 175/329; 175/339; 175/410

[58] Field of Search ..... 175/329, 330, 339, 410, 175/415, 417, 420; 407/55, 56, 57, 58, 61

[56] References Cited

U.S. PATENT DOCUMENTS

| | | | |
|---|---|---|---|
| 4,491,188 | 1/1985 | Grappendorf | 175/330 |
| 4,499,959 | 2/1985 | Grappendorf et al. | 175/410 |
| 4,529,047 | 7/1985 | Meskin et al. | 175/329 |
| 4,554,986 | 11/1985 | Jones | 175/410 |
| 4,602,691 | 7/1986 | Weaver | 175/329 |

FOREIGN PATENT DOCUMENTS 2086451 9/1984 United Kingdom .

*Primary Examiner*—Stephen J. Novosad

*Assistant Examiner*—Terry Lee Melius

[57] ABSTRACT

Hydraulic flow may be rendered substantially uniform throughout the waterways on a rotating bit from the center of the bit to the outer gage. This is accomplished by defining waterways into the bit face below a primary surface of the bit face. A colinear land is then disposed into the waterway, but does not extend above the primary surface of the bit face. A plurality of teeth are then disposed on the colinear land and extend above the primary surface of the bit face. The flow of hydraulic fluid is prevented from dispersing as the fluid moves from the center of the bit to the outer gage. Cutting by kerfing is further optimized by arranging triads of cutters on each of the pads disposed in the waterways into a set. Each triad of cutters corresponds to additional triads of cutters in azimuthally subsequent and adjacent pads in the next subsequent waterway, thereby forming the set of associated triads of cutters. Each triad of cutters in the set is radially offset from the corresponding triads in the set. Therefore, while each triad cuts through a kerfing action individually, each triad relates to the preceding triad of cutters to cut into the kerfed lands made by that preceding triad of cutters and thus to cut through a kerfing action as well.

16 Claims, 6 Drawing Sheets

86
26
86
28
34
30
36
14e
14d
14h
32
14h
14g
14f
14b
14c
12
82
80
72
78
70
76
68
66
14a
74
84
14a
14b
67
84
12
14a
73
12
84
14a

BIT DESIGN FOR A ROTATING BIT INCORPORATING SYNTHETIC POLYCRYSTALLINE CUTTERS

BACKGROUND OF THE INVENTION

1. Field of the Invention

The present invention relates to the field of earth boring tools and more particularly to rotating bits incorporating diamond elements as the active cutters.

2. Description of the Prior Art

Diamond bearing rotating bits historically have incorporated industrial quality natural diamonds as the cutting elements. These elements are fully embedded or surface set with ⅔ of the diamond within the bit in order to retain the small diamonds on the bit face under the tremendous stresses to which they were subjected during drilling. The sizes of such diamonds typically range from one to eight per karat and smaller.

Subsequently when polycrystalline diamond was first synthesized the fine diamond grit which was obtained was fabricated into larger usable pieces by sintering the diamond in a cemented system. One such diamond material is made by General Electric Co. and sold under the trademark, STRATAPAX. However, these synthetic diamond tables are temperature sensitive and tend to disintegrate at the higher temperatures such as routinely experienced in the furnacing of infiltration matrix bits. Therefore such prior art bits are able to use STRATAPAX cutters only by brazing the diamond tables to tungsten carbide studs and then disposing the studs into the steel bodied or matrix body bit.

Partially in response to the disadvantages arising from the thermal instability of STRATAPAX type cutters, somewhat more thermally stable diamond materials were developed. These materials include leached polycrystalline synthetic diamond similar to the cemented cobalt product typified by STRATAPAX cutters with the exception that all or a substantial part of the cobalt and similar cementing constituents have been acid leached from the sintered diamond. One such leached diamond product is manufactured and sold by General Electric Co. under the trademark GEOSET.

However, such leached diamond material presently commercially available is typically much smaller than the prior art STRATAPAX tables and ranges in size from a maximum of one per karat to three per karat or smaller. Therefore leached diamond product is of the same order of magnitude of size as natural diamonds and new designs were and are continuing to be demanded whereby leached diamond cutters within this size range can be usefully employed and retained upon a rotating drill bit. The prior art experience with natural diamonds, which were generally of cubic or round geometry, provides little if any instruction on how the triangular prismatic leached synthetic product can be best utilized in cutting teeth and on a drill bit to achieve high cutting rates and cutting lifetimes.

Therefore, what is needed is a design whereby synthetic polycrystalline diamond elements on a rotating drill bit can be employed in a manner to maximize cutting efficiencies, performance and lifetimes.

BRIEF SUMMARY OF THE INVENTION

The present invention is an improvement in a rotating bit having a bit face defining a primary surface and an outer gage comprising a plurality of waterways defined in said bit face below the primary surface. A corresponding plurality of tooth bearing pads are disposed in the waterways with at least one pad disposed in each waterway. The pad disposed in the waterways is characterized by an uppermost surface disposed below the primary surface of the bit face. A plurality of teeth are disposed on the pads and extend from the pads above the primary surface of the bit face. By this combination of elements, fluid disposed in the waterways at the center of said bit is substantially confined to the waterways in a substantially uniform flow extending from the center of the bit to the outer gage.

The invention can also be described as an improvement in a rotating bit including a bit face characterized by a primary surface, a source of hydraulic fluid, an outer gage and a plurality of waterways extending between said source of drilling fluid and outer gage, said improvement comprising a mechanism for maintaining flow of the drilling fluid at a substantially or approximately uniform rate along the length of the waterway, and another mechansism for exposing a plurality of teeth above the primary surface of the bit face and in the substantially uniform hydraulic flow. By this combination of elements hydraulic flow across the bit face and in the vicinity of the cutting teeth is maintained substantially constant regardless of the radial position on said bit face.

The invention further includes an improvement in a rotating bit including a plurality of cutters, where the cutters are arranged and configured to form a plurality of triads of cutters. Each triad of cutters includes at least two kerf-cutting cutters for cutting concentric parallel kerfs into a rock formation and an azimuthally displaced clearing cutter for removing an interlying land defined by the two concentric kerfs. The improvement comprises an association of the plurality of triads of cutters into sets of triads. Each set of triads of cutters are radially offset with respect to each other triad within the set so that a kerf-cutting cutter of one triad cuts into the interlying land defined by the kerf-cutting cutters of a preceding triad of the set. By reason of this combination of elements each triad of cutters cuts through an optimized kerfing action and each triad of cutters serves to cut by kerfing the rock formation which was just cut by the preceding triad of the set.

In particular, the set of triads comprises three triads of cutters. Each triad of cutters is radially offset with respect to the azimuthally preceding triad of cutters. The two cutters of each triad cut two parallel kerfs. The third following cutter of each triad is approximately radially located at the midpoint between the two preceding cutters. The first triad thus cuts three parallel kerfs spanning a radial distance defined as the triad cutting width. The second azimuthally following triad is inwardly radially offset by one third of the triad width. Each triad has the same triad width. Therefore, the kerf cut by the radially outermost cutter of the second following triad will be cut at a position one-sixth the triad width radially outward from the kerf cut by the middle cutter of the first triad. The third following triad is inwardly radially offset from the first triad by one-sixth of the triad width. Therefore, the radially outermost cutter of the third triad cuts a kerf which is offset radially outward from the middle cutter of the first triad by one-third of the triad width. As a result, the three triads will cut kerfs at each one-sixth interval of the triad width.

The invention also includes a method for cutting a rock formation with a rotating bit characterized by a plurality of synthetic polycrystalline diamond cutting elements comprising the steps of cutting a first kerf, simultaneously cutting a second parallel concentric kerf spaced apart from the first kerf by a predetermined distance with an interlying land being defined by and between the first and second kerfs. Next follows the step of removing at least part of the interlying land by a first clearing cutter, cutting a third kerf at a position offset by a predetermined fraction of the predetermined distance with the third kerf positioned between the first kerf and the second kerf. The method continues by cutting simultaneously a fourth and fifth kerf with the fourth kerf positioned between the first and third kerf, the fourth and fifth kerfs to define a second interlying land of the same predetermined radial distance therebetween. The method continues by removing at least part of the second interlying land with a second clearing tooth, wherein the second clearing tooth is positioned between the first clearing tooth and the second kerf. By reason of this combination of steps, a plurality of kerfing cuts are made, with each subsequent kerfing cut acting to kerf into the land made by the prior kerfing cuts.

The invention and its various embodiments may be better understood by now turning to the following detailed description.

DETAILED DESCRIPTION OF THE PREFERRED EMBODIMENT

The present invention is an improvement in a diamond bearing rotating bit wherein the diamond cutters are disposed on lands within the waterways defined on the bit face. The surface of the lands or cutter pads are disposed generally below the general surface of the bit face. The disposition of the diamond cutting element on the pad disposes the diamond above the general surface of the bit face. Alternatively, the noncutting bearing sections of the bit face are raised between adjacent waterways to a level above the cutter pads but below the extended reach of the diamond cutting elements themselves. By reason of this disposition, the diamond cutting elements are immersed in the hydraulic flow of the waterways which flow is thus contained as the fluid flows radially outward to the outer gage of the bit. Therefore, instead of the hydraulic flow radially dispersing as it moves toward the gage, thereby altering the fluid dynamics, the fluid is substantially retained within each waterway. Hydraulic flow is therefore maintained substantially uniform in the proximity of the cutting elements.

Some of the waterways are disposed on the bit so that they terminate in junk slots defined into the outer gage of the bit. In this case these waterways are slightly shorter than waterways which extend to the extremity of the outer gage and hence have a different fluid flow resistance. In order to compensate for the variation in flow resistance between the various waterways, the invention varies the waterway widths and depths to substantially or at least approximately equalize the effective flow resistance of each of the waterways.

Furthermore, the invention includes a collective or cooperative cutting action among a plurality of triads of cutting teeth. According to the present invention the triads themselves are associated so that the traids collectively form a kerfing cutting action themselves. In other words, the triads are associated in groups of three as well so that the triad group cuts through a larger scale kerfing action.

Figure 1:
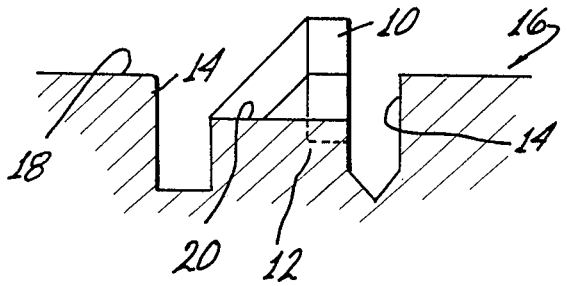
FIG. 1 is a diagrammatic cross-sectional depiction of a triangular pismatic diamond element incorporated into the present invention.

The invention can be better understood by first turning to the diagrammatic sectional view of FIG. 1.

FIG. 1 is a simplified cross-sectional view of a single tooth 10 disposed on a land 12. Land 12 in turn is disposed within a waterway 14 defined within a bit face generally denoted by reference numeral 16. According to the invention, bit face 16 is characterized by a general or primary surface 18 which extends between waterways 14 as better shown in plan view in FIG. 2. Within each waterway 14 is at least one land 12 and teeth 10 disposed upon land 12. Land 12 is characterized by having an uppermost surface 20 which lies below primary surface 18 of bit face 16. Teeth 10 are disposed on land 12 and extend upwardly beyond upper surface 20 of land 12 and beyond primary surface 18 of bit face 16. Therefore at least a portion of tooth 10 is exposed above the outermost extending surface, primary surface 18 of bit face 16. Tooth 10 has been diagrammatically shown as having a generally triangular cross section and simply placed upon land 12. However, it must be understood that the tooth structure may include any design now known or later devised. In the illustrated embodiment, as will be shown in greater detail in connection with FIGS. 3*a–b* and 4, the tooth structure is substantially more complex than that depicted in FIG. 1 and includes various means for retaining the tooth on the bit while also maximizing exposure of the diamond cutting element.

Figure 2:
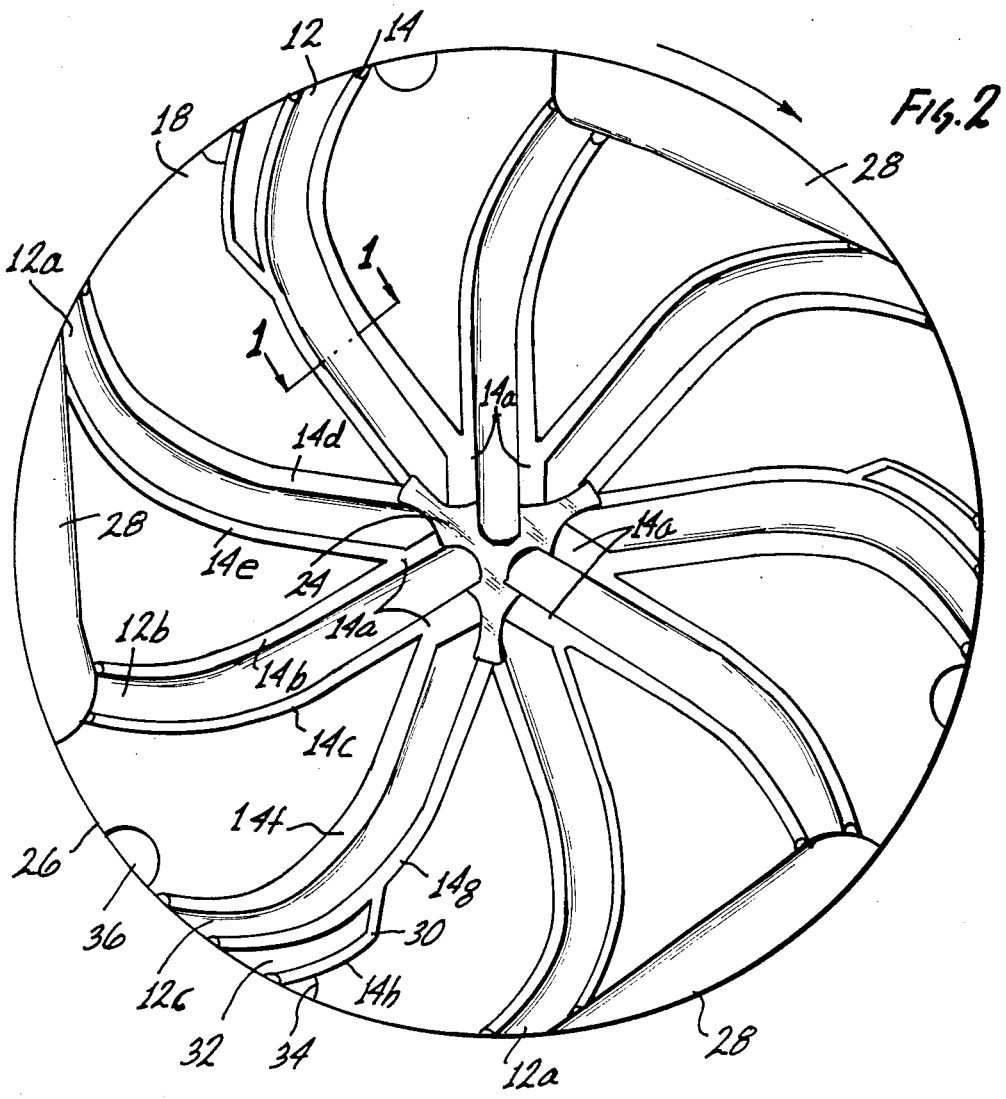
FIG. 2 is a simplified plan view of a petroleum bit incorporating the invention illustrated in FIG. 1.

However, turn first to the plan view of FIG. 2 which shows a petroleum bit, generally denoted by reference numeral 22 in which a plurality of reversed spiral waterways 14 are defined. Within each waterway is at least one land 12 upon which teeth 10 are disposed (not shown). Waterways 14 communicate with a central crowfoot 24 through which drilling fluid is supplied from the interior bore of the drill string. Drilling fluid exits crowfoot 24 and enters the plurality of waterways 14 communicating with crowfoot 24 at the center of bit 22. From the center of bit 22 the drilling fluid proceeds radially outward along the reverse spirals of waterways 14 to outer gage 26. Outer gage 26 furthermore has a plurality of junk slots 28 defined therein. Junk slots 28 similarly communicate with certain ones of the waterways such as waterways **14*b*, 14*c* and 14*e* while waterways 14 *d*, 14*f*, 14*g* and 14*h*, for example, lie entirely between junk slots 28 and extends to the outer most perimeter of gage 26. In each case, tooth bearing lands 12 are disposed within the center of waterways 14 in the manner diagrammatically depicted in FIG. 1, which is a cross-sectional view taken through line 1—1 of FIG. 2. Drilling fluid flows on both sides of land 12** and tends to be confined and channeled within the respective waterway during the course of its entire transit.

Turning to the plan view of FIG. 2, waterways 14 are set forth on the face of the bit in the illustrated embodiment in a threefold symmetry. Consider the waterways as provided in one of the three sectors, the waterways in the remaining two sectors being identical. Crowfoot 24 communicates directly with waterway **14*e*, 14*g* and waterways 14*a*. Waterway 14*d* is a singular or nonbifurcated waterway which extends from the crowfoot to the extremity of gage 26. Waterways 14*a* are each bifurcated in that they communicate at one end with crowfoot 24 and later divide into a purality of subwaterways. For example, the first of waterways 14*a* bifurcates into waterways 14*e* and 14*b*. The second of waterways 14*a* bifurcates into waterways 14*c* and 14*f*. Waterway 14*g* communicates directly with crowfoot 24 and extends toward gage 26 but bifurcates into two waterways 14*h* in its outermost radial portion. The hydraulic characteristics of each of these waterways are approximately equivalent although the sink in which they terminate, the source from which they originate, and the lengths of their runs may each be different. The hydraulic performance is maintained approximately uniform along the waterways and within any given waterway from its innermost to outermost point by the branching as depicted in FIG. 2 and furthermore by proportionate dimensioning of the waterway. For example, waterways 14*a* are approxately 0.25" in width and 0.094" in depth with a generally rectangular cross section. Waterway 14*e* which branches from the first of waterways 14*a* and radially extends to the leading edge of junk slot 28 has a width of approximately 0.125" and a depth of 0.047" with a rectangular cross section. Waterway 14*b* which is the companion branch to waterway 14*e*, extends to the rear portion of junk slot 28 and is characterized by a width of approximately 0.187" and a depth of 0.104" with a V-bottom cross section. The second waterway 14*a* bracnhes into waterway 14*c* which has a width of approximately 0.125" and a depth of 0.031" with a rectangular cross section. Waterway 14*f*, which also originates with second waterway 14*a*, is led to the gage 26 near collector 36. Waterway 14*c* is led to a rear portion of junk slot 28. Waterway 14*f* has a cross-sectional configuration approximately equivalent to waterways 14*g* and 14*h*, namely a width of approximately 0.187" and a depth of 0.160" with a triangular cross section. Waterways 14*h* which provide the outermost radial portions for waterway 14*g* have a full cross section approximately equal to that of waterway 14*e*. Therefore, the cross sections or TFA's of each of the waterways, regardless of the exact details of their termination or sink at gage 26 are provided with a substantially uniform rate of volume or fluid per tooth across the face of the bit. Thus, in this sense, the flow of drilling fluid is approximately equally distributed among all of the waterways on bit 22**.

Before further considering the overall bit design, turn now to the details of the tooth configuration as used in the illustrated embodiment.

Figure 3A:
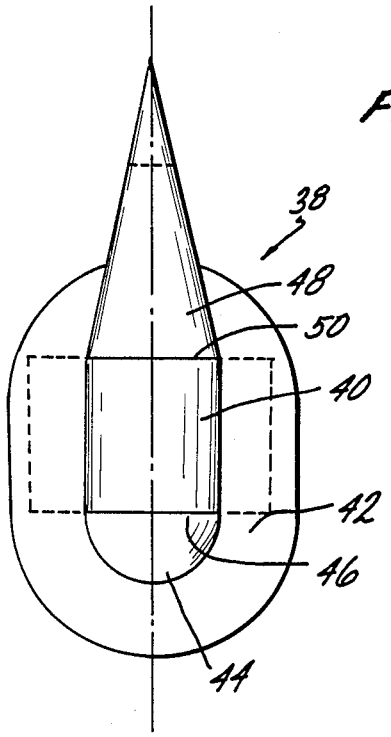
FIG. 3*a* is a plan view in an enlarged scale of one tooth as used in the embodiment as used in FIGS. 1 and 2.
Figure 3B:
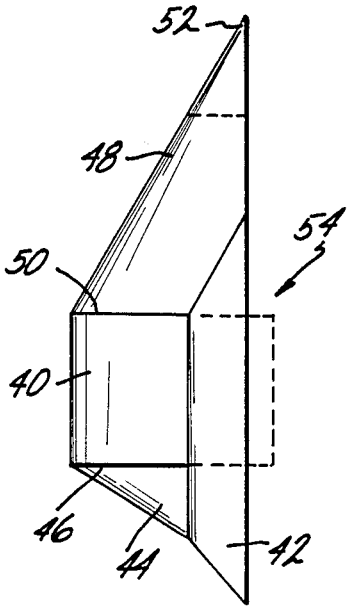
FIG. 3*b* is a side elevational view of the tooth shown in FIG. 3*a*.

Turning to FIG. **3*a*, a tooth, generally denoted by reference numeral 38, is shown in enlarged scale in plan view. Tooth 38, as described in greater detail in the application entitled "Improved Diamond Cutting Element in a Rotary Bit", filed Mar. 7, 1983, Ser. No. 473,020 (now issued), assigned to the same assignee as the present invention, is comprised of a diamond cutting element 40 around which an integral collar of matrix material 42 has been formed. A prepad 44 of matrix integrally extends from collar 42 and is contiguous and congruous with the front face of diamond element 40. In alternative embodiments prepad 44 may in fact not be congruous with the front face 46 of diamond element 40 and may contact only a portion of the front face. In the illustrated embodiment diamond element 40 is a prismatic triangular polycrystalline synthetic diamond such as sold by General Electric Co., under the trademark GEOSET. A tapered tail 48 of integrally formed matrix material extends from the rear face 50 of diamond element 40 to the surface 52 of the land 12 as better illustrated in connection with the side elevational view of FIG. 3*b*. As illustrated in FIG. 3*b* only a small portion 54 of diamond element 40 remains embedded below the surface 52 and diamond element 40 is substantially exposed thereabove and supported by the surrounding tooth structure. As described below, surface 52** is the uppermost surface of the pad on which the tooth is disposed and in fact lies below the primary surface of the bit face.

Figure 4:
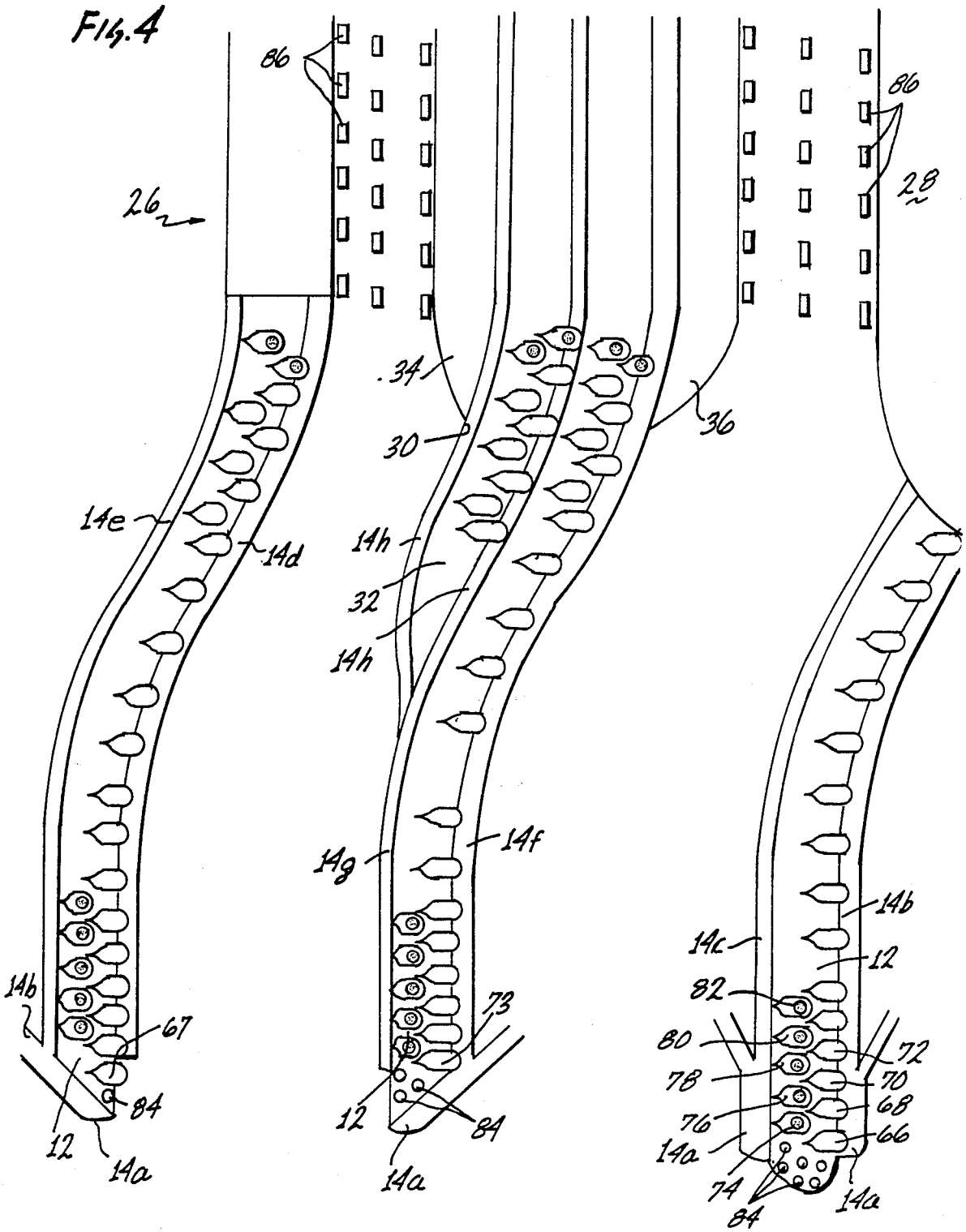
FIG. 4 is a plot diagram of diamond teeth upon the cutting lands of the bit illustrated in FIG. 2.

Turn now to FIG. 4 which illustrates the plot detail of the teeth such as shown in FIGS. **3*a* and 3*b* in the petroleum bit shown in plan view in FIG. 2. The design of bit 22 of FIG. 2 is divided into three sectors. Each 120° sector is identical to the other and includes three waterways. Waterways 14*a–h*, for example, comprise eight waterways in one sector of bit 22. One such sector is illustrated in the plot diagram of FIG. 2 which is a diagrammatic view of one of the pie-shaped sectors which has been figuratively cut from bit 22 and laid out flatly to show the plot detail. The plot detail from the center of the bit extending outwardly and down outer gage 26 is shown. A curved surface has been imaginarily cut from bit 22 and laid out to form a flat illustration as in FIG. 4**. The proportions and distances between elements as illustrated are approximately true on each land, although the distance between lands is necessarily distorted in order to represent the three-dimensional surface in two dimensions.

Turn first to FIG. 4. A first row of leading teeth 66–72 and so forth are disposed on land 12 within waterways **14*a–c*. Each of the teeth of the leading row, such as teeth 66–72, are one per carat in size and are of a design and structure such as shown by tooth 38 of FIGS. 3*a* and 3*b*. Behind the leading row of teeth is a second row of teeth on land 12, such as teeth 74–82, which lie in the half spaces between the teeth of the preceding row. Again the teeth of the second or trailing row, such as teeth 74–84, are similar in design, disposition and structure to tooth 64** of the triad of teeth as shown in FIGS. *3a* and *3b* but are three per carat in size and are provided as redundant cutters and nose protectors according to conventional design.

Land 12 may also be provided with conventional cutters, such as natural diamond surface-set elements, generally denoted by reference numeral 84, which provide for abrasion resistance and apex protection in the conventional manner. Similar synthetic polycrystalline surface-set GEOSETS 86 are provided for abrasion resistance in outer gage 26 as depicted by the exposed rectangular faces (86) in FIG. 4.

Thus, each of the other waterways 14*a–h* similarly include lands 12 which are also provided with a leading row of cutting teeth and a following row in the half spaces. In connection with waterway 14*h*, land 32 is also similarly provided with a double row of similarly arranged cutters.

It can now be particularly appreciated that the teeth on the plurality of lands 12 form a plurality of triads. Turning specifically to teeth 68, 70 and 76, a first triad is formed nearest the center of the bit. The next triad is then comprised of tooth 70, 73 and 78. Thus, each tooth within the leading row forms one of the teeth of both of the adjacent triads.

However, according to the present invention the kerfing action of each triad of teeth combines to co-act with its associated triads as will now be described in greater detail in connection with the illustrations of FIGS. 5*a* and 5*b–7a, 7b,* as embodied on the mining bit shown in FIG. 9. FIGS. 5*a* and 5*b–7a, 7b* are cross-sectional depictions of a mold into which the triangular prismatic diamond elements are disposed as described above, and which are then filed with conventional matrix powder and infiltrated by well known processes. In each case, the resulting tooth structure is substantially that as shown in FIGS. 3*a* and 3*b* with the cross section of FIGS. 5*a, b–7a, b* taken through a plane perpendicular to the longitudinal, prismatic axis of the triangular diamond element.

Figure 8:
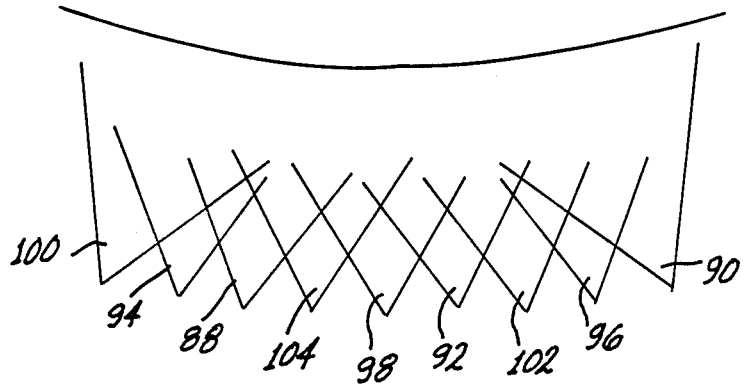
FIG. 8 is a diagrammatic depiction of the pattern of coverage of the triad of teeth formed in the molds depicted in FIGS. 5*a–b*, 6*a–b* and 7*a–b*.

A collection of triads of the type as described in connection with FIGS. 5*a,b–*9 is described in connection with a nose section segment such as diagrammatically depicted in FIG. 8. The combination as will be described below is then easily adapted according to the present teachings to the particular design of the petroleum bit 22 as shown in FIG. 2 and more particularly in FIG. 4.

Consider first, however, a nose section incorporating the invention. FIG. 5*a* depicts the placement of a first pair of teeth formed in corresponding indentations 88 and 90. Hereinafter the indentations in the molds of FIGS. 5*a,b–7a,b* will be referenced interchangeably with the teeth which will be formed in the corresponding indentations. Thus, for the purposes of this description, references to indentation 88 and tooth 88 will be used interchangeably. For example, tooth 88 is disposed so that the center line of the tooth, namely, the angular bisector of the apical ridge of the triangular prismatic tooth, is tilted with respect to the vertical by approximately 9 degrees. Tooth 90, that is the tooth formed within indentation 90, is similarly but oppositely outwardly inclined from the vertical by approximately 24 degrees.

Figure 5A:
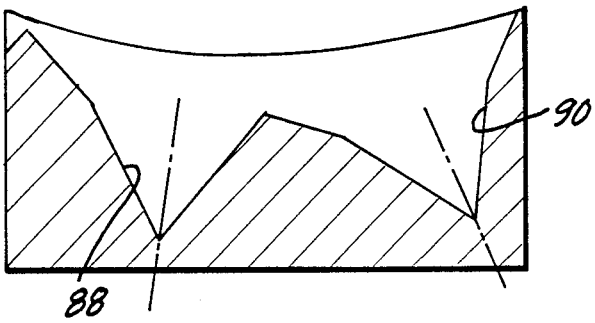
FIGS. 5*a* and 5*b* are cross-sectional views in enlarged scale of a mold used to dispose a first triad of teeth associated as depicted in FIG. 3*a–b* in an infiltration matrix bit as shown in FIG. 9.
Figure 5B:
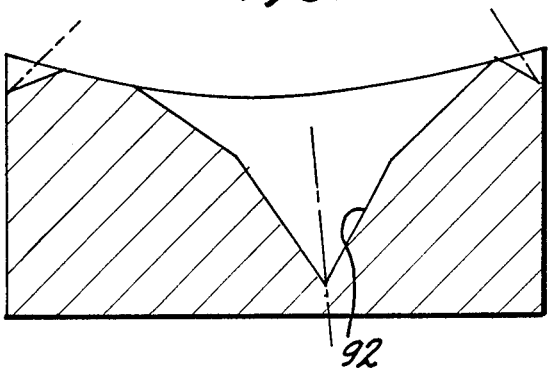

The third tooth of the first triad is formed within the mold as depicted in FIG. 5*b*. Tooth 92 is formed so as to be outwardly inclined by approximately 4 degrees from the vertical.

Figure 6A:
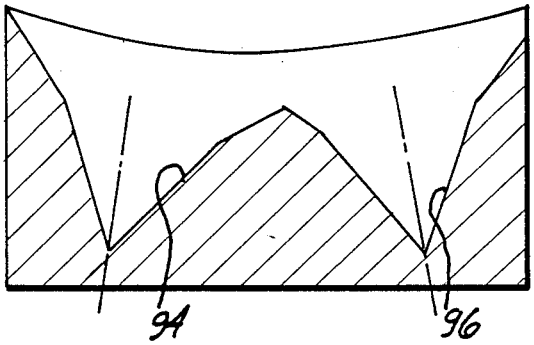
FIGS. 6*a* and 6*b* are cross-sectional views in enlarged scale of a mold for a second triad of teeth disposed in an infiltration matrix bit as shown in FIG. 9.
Figure 6B:
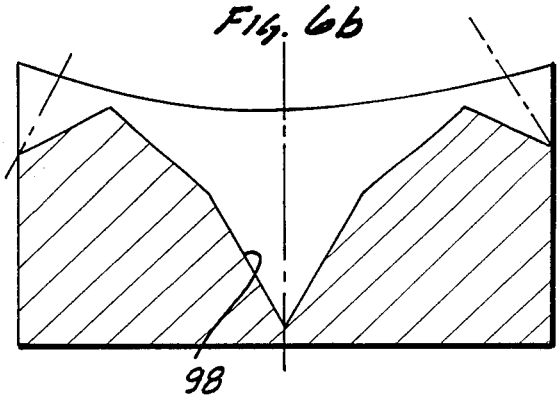

The second triad of teeth includes a pair of teeth formed in the mold as depicted in FIG. 6*a*. Tooth 94 is angled with respect to the vertical so as to be inclined 11 degrees inwardly while tooth 96 is inclined 11 degrees outwardly. In the second triad the third tooth or clearing tooth 98 is formed so as to lie directly on the vertical as shown in cross-sectional view in the mold drawing of FIG. 6*b*.

Figure 7A:
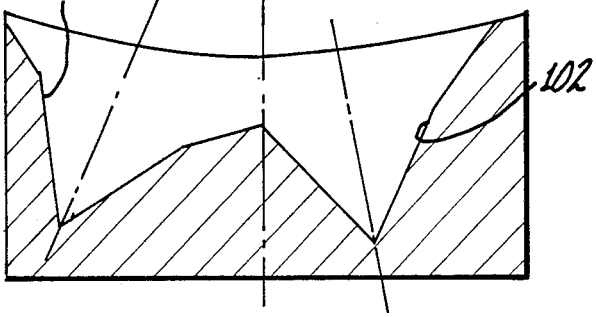
FIGS. 7*a* and 7*b* are cross-sectional views in enlarged scale of a mold for a third triad of teeth associated as depicted in FIG. 4 and disposed in an infiltration matrix bit as shown in FIG. 9.
Figure 7B:
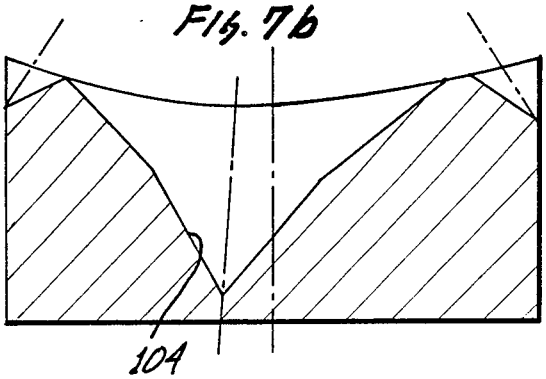

The third triad is depicted in the mold drawings of FIGS. 7*a* and 7*b*. The first pair of teeth of the third triad is depicted in FIG. 7*a* and includes tooth 100 which is inclined inwardly by 24 degrees, and tooth 102 which is inclined outwardly by 9 degrees. Finally, the third tooth or clearing tooth 104 of the third triad is depicted in FIG. 7*b* and is inclined inwardly by approximately 4 degrees.

During rotation of the bit the triads will azimuthally pass any given radial line in the order of first, third and then second triad.

Figure 9:
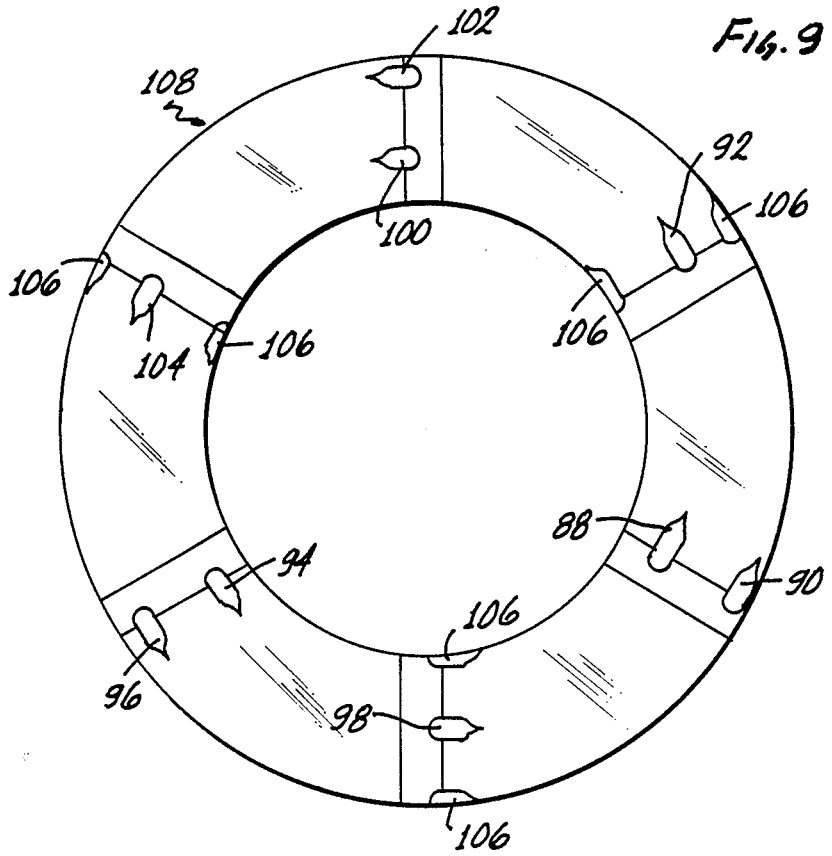
FIG. 9 is a plan view of a mining bit fabricated according to the tooth placement described in connection with FIGS. 5*a, b*–8

The angular displacements from the vertical of the kerf cutting teeth are slightly asymmetric due to the limited radial space available on bit 108 of FIG. 9 in view of the radial width required for collar 42 of each tooth and the one per carat diamond 40 employed (FIGS. 3*a*, 3*b*). The tips of each diamond cutter, however, are approximately evenly spaced across the crowned face of bit 110 as diagrammatically depicted in FIG. 8. In a larger bit, the angular inclinations could be made symmetric if space permitted.

Consider now the pattern of coverage provided by the three triad of teeth formed in the molds as depicted in FIGS. 5*a,b–7a,b*. As the first triad of teeth formed from the molds depicted in FIGS. 5*a,b* cuts through the rock formation as the bit is rotated, kerf lines are cut by teeth 88 and 90. Thereafter, tooth 92, which is azimuthally displaced behind teeth 90 and 88, follows and clears, at least to an extent, the interlying land between the kerfs cut by teeth 90 and 88. The next triad of teeth, the third triad as depicted in FIGS. 7*a,b* then pass through the given plane. Teeth 102 and 100 each cut a kerf. However, the kerf cut by tooth 102, for example, is in an interlying land between the kerfs cut previously by teeth 90 and 92. Therefore, at least to an extent, tooth 102 acts as a clearing tooth. Similarly, tooth 100 cuts a kerf to establish an interlying land between the kerf cut by tooth 88 and tooth 100. Thereafter, the azimuthally displaced tooth 104 of the third triad of cutters follows and cuts a kerf into the land interlying between the kerfs previously cut and defined by teeth 88 and 92. Therefore, at least to an extent, tooth 104 also serves as a clearing tooth with respect to kerfs cut by two of the teeth of the preceding triad.

Finally, the second triad of teeth passes through the given plane. Tooth 94 acts as a clearing tooth to cut the interlying land between the kerfs defined and cut by preceding teeth 88 and 100 of the first and third triad respectively. Similarly, tooth 96 acts as the final clearing tooth to clear the land left between teeth 102 and 90 of the third and first triads respectively. The clearing tooth 98 of the second triad of teeth then follows acting as a final clearing tooth for the land defined between the kerfs cut by teeth 92 and 104 of the first and third triads respectively.

Figure 10A:
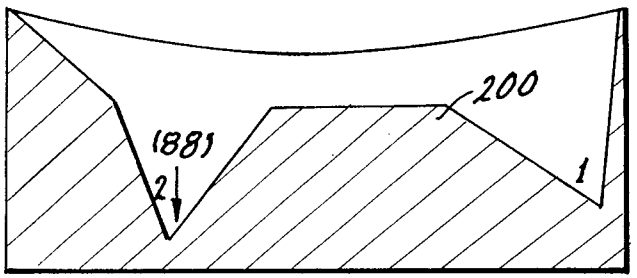
FIGS. 10*a*–10*f* are diagrammatic, sequential cross-sectional depictions of cuts in a rock formation made by the teeth of FIGS. 8 and 9.
Figure 10D:
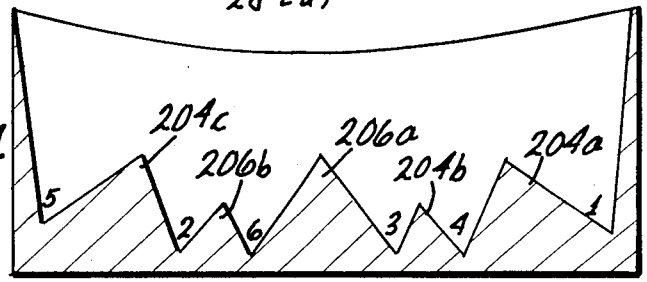
Figure 10B:
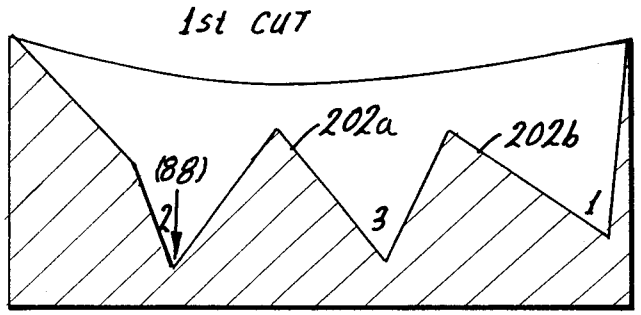
Figure 10E:
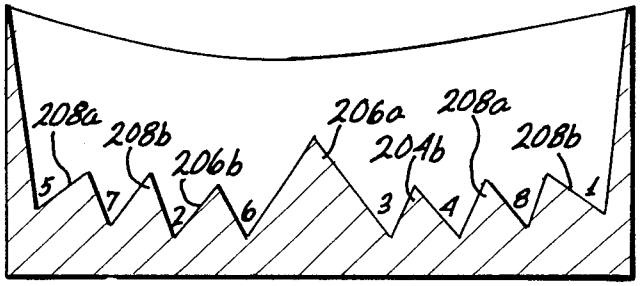
Figure 10C:
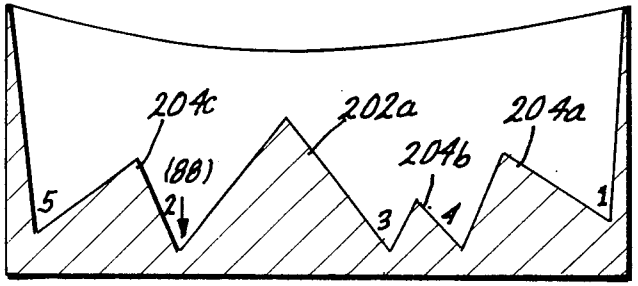
Figure 10F:
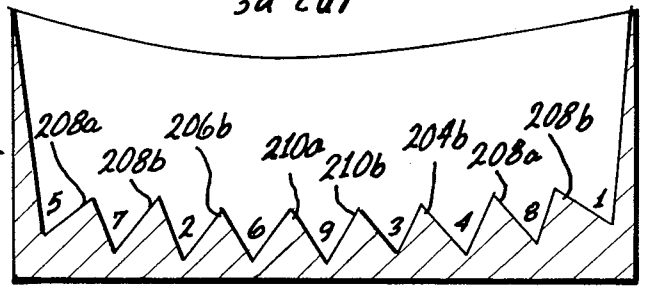

FIGS. 10*a–f* more graphically and clearly depict the sequence of cutting according to the invention as just described, and as is implicit in the descriptions of FIGS. 5*a,b–*9. FIG. 10*a* is a diagrammatic depiction of the kerfs cut into the rock after traversal of teeth 88 and 90 through the plane of observation. FIG. 10*b* is a diagrammatic cross-sectional view of the rock after traversal of the following clearing tooth 92. FIG. 10*b* thus represents the cutting action of the first triad in isolation. FIG. 10*c* is a cross-sectional view of the rock following the traversal of the first two teeth of the third triad, teeth 100 and 102. FIG. 10*d* is a cross-sectional view of the rock following the subsequent traversal of the clearing tooth 104 of the third triad. Thus, FIG. 10*d* represents the cumulative cutting action of the first and third triads. FIG. 10*e* is a cross-sectional view of the removed rock after the next subsequent traversal of the first two teeth of the second triad, teeth 94 and 96. FIG. 10*f* is a cross-sectional view of the removed rock after the traversal of the final clearing tooth 98 of the second triad and represents the cumulative kerfing action of all three triads. Returning to FIG. 10*a*, the cutting action can then be viewed and described as the creation and kerfing into a number of defined lands in the rock formation. For example, in FIG. 10*a* two kerfs are cut to define a single large interlying land 200. Thereafter, land 200 is kerfed to form two separated lands 202*a* and 202*b*. Next, as shown in FIG. 10*c*, land 202*b* is cut in asymmetric fashion to form land 204*a* and a smaller land 204*b*. As seen in FIG. 10*b*, land 202*a* is then cut to form land 206*a* and a smaller land 206*b*. Land 204*c* is further defined by cutting an additional kerf outside of that cut by tooth 88, shown in parentheses in FIG. 10*a*–10*c*. Thereafter, lands 204*a* and 204*c* are each then kerfed again to form two smaller lands 208*a* and 208*b*. Finally, land 206*a* is kerfed to reduce it to smaller lands 210*a* and 210*b*. Thereafter, the cutting action continues in an analogous manner as depicted in the cycle represented by FIGS. 10*a*–10*f*.

The disposition of the three triads of teeth is better understood by referring briefly to the plan view as depicted in FIG. 9. FIG. 9 illustrates a crowned mining core bit 108 in which teeth 90–104 are disposed. In addition thereto, secondary gage protection teeth 106 are provided to establish the inner and outer gages of the mining bit according to conventional means. It can now be readily appreciated that whereas the first triad of teeth 88–92 form a kerf cutting action among themselves on a first or larger scale, each of the triads of teeth coact with the other triads of teeth to cut by kerfing on a second or smaller scale. In other words, whereas teeth 88 and 90 cut two kerfs into the rock formation which defines the land between them which is then to be cleared by clearing tooth 92, should the land fail to be cleared the azimuthally following tooth 102 of the third triad and tooth 96 of the second triad will cut any remaining portions of the land left between tooth 92 and 90 while azimuthally following teeth 98 of the second triad and tooth 104 of the third triad will cut any remaining portion of the interlying land between tooth 92 and 88 of the first triad. In the meantime each of the triad of teeth in the third and second triads similarly cut among themselves by a kerfing action with the remaining triad of teeth redundantly covering the interlying lands left, if any, between that triad as well.

Although not readily apparent from the depiction of FIG. 4, the triad of teeth on land 12*b* form a similar relationship with respect to the triads of teeth on lands 12*a* and 12*c* azimuthally following behind. The particular angles called out with respect to the illustrated embodiment of FIGS. 7*a,b*–9 are particular to the illustrated mining bit 108 of FIG. 9 and the angles would be appropriately changed to conform to the profile of petroleum bit 22 in the embodiment of FIG. 4. Nevertheless, the conceptual relationship between the consecutive triads of teeth is the same in each of the embodiments.

Many modifications and alterations may be made by those having ordinary skill in the art without departing from the spirit and scope of the present invention. The illustrated embodiment has been set forth only for the purposes of example and should not be taken as limiting the invention which is defined in the following claims.

I claim:

1. An improvement in a rotating bit having a bit face defining a primary surface and an outer gage comprising:

a plurality of generally radial and hydraulically straight waterways defined in said bit face below said primary surface;

a corresponding plurality of tooth bearing pads disposed within said radial waterways, at least one pad disposed within each radial waterway, each said radial waterway extending azimuthally in front of and behind each pad, said pad disposed in said waterway characterized by an uppermost surface disposed below said primary surface of said bit face; and a plurality of teeth disposed on said pads, said teeth extending from said pads above said primary surface of said bit face, so that fluid disposed in said radial waterways at the center of said bit is substantially confined to said radial waterways in a substantially uniform and hydraulically straight flow extending from the center of said bit to said outer gage without being required to substantially change direction of flow across said bit face.

2. The improvement of claim 1 wherein at least some of said waterways have an unequal length, each said waterway characterized by a corresponding uniform cross section and selected depth throughout each said waterway to render the flow resistance of each waterway substantially equal to each other waterway, whereby hydraulic performance of each of said waterways is substantially equalized.

3. The improvement of claim 2 further comprising at least one auxiliary waterway communication with a selected one of said waterways and at least one auxiliary collector defined in said gage, said auxiliary waterway communicating with said collectors.

4. The improvement of claim 3 further comprising at least two auxiliary broaches defined into said gage and wherein said waterway and corresponding auxiliary waterway each communicate with one of said two auxiliary broaches.

5. An improvement in a rotating bit including a bit face characterized by a primary surface, a source of drilling fluid, an outer gage and a plurality of generally radial and generally straight waterways extending between said source of drilling fluid and outer gage, said improvement comprising:

means for substantially confining the flow of said drilling fluid in said waterways in a substantially hydraulically straight and uniform flow path from said source of fluid to said outer gage; and means for exposing a plurality of teeth above said primary surface of said bit face and in said substantially uniform and hydraulically straight hydraulic flow path;

wherein said means for exposing said teeth in said substantially uniform and hydraulically straight flow path across said bit face comprises at least one pad. disposed within and colinear with said waterways so that the uppermost surface of said pad is beneath the level of said primary surface of said bit face, whereby hydraulic flow across said bit face and in the vicinity of said cutting teeth is controlled regardless of the radial position on said bit face.

6. The improvement of claim 5, wherein said means for exposing said plurality of teeth comprises a tooth structure means for retaining each cutting tooth on said pad and for exposing said cutting tooth above said primary surface of said bit face.

7. The improvement of claim 6 wherein said means for equalizing hydraulic flow among said waterways comprises a corresponding uniform cross section and selected depth for each waterways, said corresponding uniform cross section and selected depth dimensioned to approximately equalize flow resistance among each of said waterways.

8. An improvement in a rotating bit including a first plurality of cutters, said cutters arranged and configured to form a second plurality of triads of cutters, each triad of cutters including at least two kerf-cutting cutters for cutting concentric parallel kerfs into a rock formation and an azimuthally displaced clearing cutter for removing an interlying land defined by said two concentric kerfs, said improvement comprising:

association of said second plurality of triads of cutters into at least two sets of triads, each set of triads of cutters radially offset with respect to each other triad within said set so that kerf-cutting cutter of one triad cuts into said interlying land defined by said kerf-cutting cutters of a preceding triad of each set, whereby each triad of cutters cuts through an optimized kerfing action and wherein each triad of cutters serves to cut by kerfing said rock formation as cut by the preceding triad of each set.

9. An improvement in a rotating bit including a plurality of cutters, said cutters arranged and configured to form a plurality of triads of cutters, each triad of cutters including at least two kerf-cutting cutters for cutting concentric parallel kerfs into a rock formation and an azimuthally displaced clearing cutter for removing an interlying land defined by said two concentric kerfs, said improvement comprising:

association of said plurality of triads of cutters into sets of triads, each set of triads of cutters radially offset with respect to each other triad within said set so that kerf-cutting cutter of one triad cuts into said interlying land defined by said kerf-cutting cutters of a preceding triad of each set, wherein said set of triads of cutters comprises three triads of cutters, each triad of cutters being radially offset with respect to the azimuthally preceding triad of cutters of said set by on-sixth of said inter-kerf distance defined between said kerfs but by said two kerf-cutting cutters of each triad, whereby each triad of cutters cuts through an optimized kerfing action and wherein each triad of cutters serves to cut by kerfing said rock formation as cut by the preceding triad of each set.

10. The improvement of claim 9 wherein each cutter of each triad incorporates radially set prismatic triangular diamond element.

11. An improvement in a rotating bit including a plurality of cutters, said cutters arranged and configured to form a plurality of triads of cutters, each triad of cutters including at least two kerfcutting cutters for cutting concentric parallel kerfs into a rock formation and an azimuthally displaced clearing cutter for removing an interlying land defined by said two concentric kerfs, said improvement comprising:

association of said plurality of triads of cutters into sets of triads, each set of triads of cutters radially offset with respect to each other triad within said set so that kerf-cutting cutter of one triad cuts into said interlying land defined by said kerf-cutting cutters of a preceding triad of each set, a plurality of waterways defined in said bit face, said bit face characterized by a primary surface, said waterways defined below said primary surface, at least one colinear pad disposed in each of said waterways, said pad disposed beneath said primary surface, at least one of said triad of cutters disposed on said pad and extending from said pad above said primary surface of said bit face, each one of said waterways and corresponding pads being sequentially azimuthally displaced one from the other and including a corresponding succeeding one of said triads of said set of triads, whereby cutting through kerfing action is optimized and a substantially uniform hydraulic flow is achieved in the proximity of each cutter, and whereby each triad of cutters cuts through an optimized kerfing action and wherein each triad of cutters serves to cut by kerfing said rock formation as cut by the preceding triad of each set.

12. An improvement in a rotating bit including a plurality of cutters, said cutters arranged and configured to form a plurality of triads of cutters, each triad of cutters including at least two kerf-cutting cutters for cutting concentric parallel kerfs into a rock formation and an azimuthally displaced clearing cutter for removing an interlying land defined by said two concentric kerfs, said improvement comprising:

association of said plurality of triads of cutters into sets of triads, each set of triads of cutters radially offset with respect to each other triad within said set so that kerf-cutting cutter of one triad cuts into said interlying land defined by said kerf-cutting cutters of a preceding triad of each set, wherein said teeth disposed on said pads are arranged on each pad to form a plurality of triads, each triad including at least a first and second tooth for cutting concentric parallel kerfs and a third tooth for clearing the interlying land defined by said two concentric kerfs cut by said first and second teeth, said triads of teeth on three azimuthally consecutive pads disposed in correspondingly azimuthally consecutive waterways comprising a set of triads of teeth, each triad of teeth radially offset from said corresponding triads of teeth in said set by a predetermined distance, said first and second teeth of said radially offset triads positioned to cut said interlying land defined by said first and second teeth of a preceding triad of said set, whereby each triad of cutters cuts through an optimized kerfing action and wherein each triad of cutters serves to cut by kerfing said rock formation as cut by the preceding triad of each set.

13. The improvement of claim 12 wherein said set of triad of cutting teeth comprises at least three triads of cutting teeth and wherein said predetermined distance of radial offset is one-sixth the radial distance of said interlying land defined by said two kerf-cutting teeth of a preceding triad of cutters of said set.

14. The improvement of claim 12 wherein each said cutting tooth comprises a radially set triangular prismatic polycyrstalline diamond element.

15. The improvement of claim 14 wherein said first and second teeth each comprise a first predetermined size of prismatic triangular diamond cutting element and said third clearing tooth comprises a second equal or smaller size triangular prismatic diamond cutting element.

16. A method for cutting a rock formation with a rotating bit characterized by a plurality of synthetic polycrystalline diamond cutting elements comprising the steps of:

cutting a first kerf;

cutting a second parallel concentric kerf spaced apart from the first kerf by a predetermined distance, an interlying land being defined by said first and second kerfs;

removing at least part of said interlying land by a first clearing cutter cutting a third kerf;

cutting a fourth kerf at a position offset by a predetermined fraction of said predetermined distance, said fourth kerf positioned between said first and third kerf;

cutting a fifth kerf positioned radially inside of said second kerf, said second and fifth kerfs defining a second interlying land of said predetermined radial distance therebetween;

removing at least part of said second interlying land with a second clearing tooth cutting a sixth kerf, said second clearing tooth positioned between said first clearing tooth and said second kerf; and wherein each of said foregoing steps is performed at any given radial section within said rock formation during a single rotation of said rotating bit, whereby a plurality of kerfing cuts are made, with each subsequent kerfing cut acting to kerf into the land made by the prior kerfing cuts.

* * * * *